US005768963A

United States Patent [19]

Bruehwiler

[11] Patent Number: 5,768,963

[45] Date of Patent: Jun. 23, 1998

[54] METHOD AND APPARATUS FOR PUNCHING A STACK

[75] Inventor: Michel G. Bruehwiler, Babson Park, Mass.

[73] Assignee: Blumer Maschinenbau AG, Otelfingen, Switzerland

[21] Appl. No.: 666,387

[22] PCT Filed: Oct. 17, 1995

[86] PCT No.: PCT/CH95/00241

§ 371 Date: Aug. 7, 1996

§ 102(e) Date: Aug. 7, 1996

[87] PCT Pub. No.: WO96/12593

PCT Pub. Date: May 2, 1996

[30] Foreign Application Priority Data

Oct. 20, 1994 [CH] Switzerland ..... 03 154/94

[51] Int. Cl.[6] ..... B26D 7/18; B26F 1/40

[52] U.S. Cl. ..... 83/27; 83/50; 83/55; 83/91; 83/112; 83/123; 83/569

[58] Field of Search ..... 83/123, 158, 160, 83/431, 566, 568, 569, 23, 50, 55, 91, 90, 27, 112, 153

[56] References Cited

U.S. PATENT DOCUMENTS

| | | | |
|---|---|---|---|
| 2,483,735 | 10/1949 | Noell | 83/123 X |
| 3,290,977 | 12/1966 | Brestel et al. | 83/566 X |
| 3,505,918 | 4/1970 | Schneider | 83/123 X |
| 3,546,990 | 12/1970 | Schneider | 83/123 X |
| 3,741,057 | 6/1973 | Maschinot | 83/569 X |
| 5,183,247 | 2/1993 | Blumer . | |

FOREIGN PATENT DOCUMENTS

| | | |
|---|---|---|
| 0 273 690 A2 | 7/1988 | European Pat. Off. . |
| 361615 | 7/1905 | France . |
| 743981 | 4/1933 | France . |
| 611655 | 3/1935 | Germany . |
| 40 13 071 A1 | 6/1991 | Germany . |
| 844564 | 8/1960 | United Kingdom . |
| 1 213 214 | 11/1970 | United Kingdom . |

*Primary Examiner*—Eugenia Jones
*Attorney, Agent, or Firm*—Oliff & Berridge, PLC

[57] ABSTRACT

In the punching of a stack (7) of sheet-like articles, especially labels made from paper or paperboard, with a punching knife (4), a punching ram (3) which can be moved to the punching knife (4) and a counter-pressure plunger (5) which is guided through the punching knife (4), the punching knife (4) and the counter-pressure plunger (5) are arranged on the carriage (10) which can be moved towards and away from the punching ram (3). As a result, a receiving apparatus (26) which can be moved laterally towards and away from the punching area can remove the ready-punched stack (21) and at the same time a new stack (7) of precut sheets can be presented to the punching ram (3).

18 Claims, 3 Drawing Sheets

METHOD AND APPARATUS FOR PUNCHING A STACK

Figure 1:
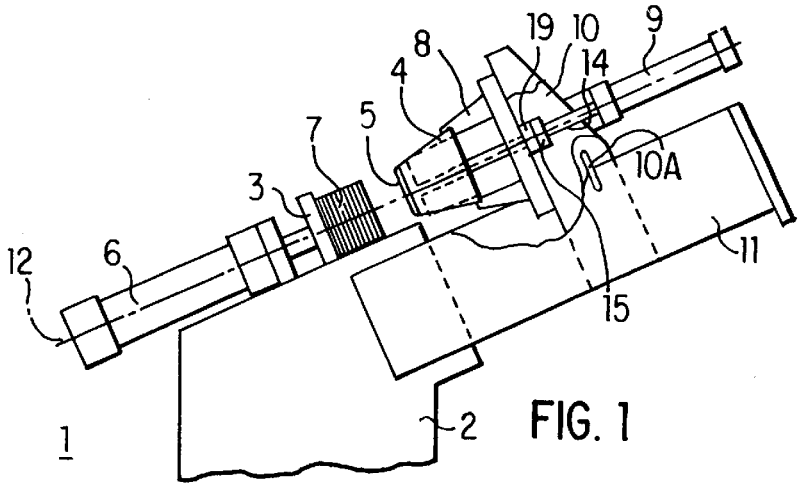

The invention relates to a method and an apparatus for punching a stack of sheet-like articles, especially labels.

In the punching of labels by the method known as penetration punching, it is generally known that the stack of precut labels is pressed in one stroke through a punching knife. The punched labels are automatically pushed through the punching knife by the subsequent stack. When the blade of the punching knife penetrates into the precut labels, the problem arises in this punching method that, in particular, the upper sheets of the stack bend, which results in inaccuracies in the form of a type of "cushion formation" with punching offsets within the stack.

In order to eliminate these disadvantages, it is proposed in DE-A-4,013,071 that a pressure ram be pressed against the stack on the opposite side of the table top that serves as a punching ram, in order to guide the stack through the punching knife in a vertical pressure position. In this penetration punching method, the stack is pushed through the punching knife by a lifting apparatus in the table top, designed as a plunger, together with the pressure ram generating the counter-pressure. The table top is then lowered with the lifting apparatus and the pressure ram is raised. The ready-punched stack is then passed to a bundling station by a horizontally displaceable transport clamp.

Although this apparatus permits a precise punching of the labels, the working speed is considerably slowed by the various additional interventions with the pressure ram and the lifting apparatus. In particular, the lifting apparatus initially has to be retracted before the table top can again be brought into its initial position and receive a new stack.

The object of the present invention is to provide a stamping method which guarantees both a high stamping quality and a high working speed of the stamping apparatus.

This object is achieved by a stamping method and the stamping apparatus.

The most important advantage of this invention is that a new stack of sheet-like articles, especially labels, can again be presented to the punching ram while, at the same time, the ready-punched stack of labels is still being removed from the punching knife. Deformations and/or indentations in the punched labels which arise as a result of the penetration of the punched stack by a ram, as in the method using the apparatus according to DE-A-4,013,071, are also avoided in a particularly advantageous manner. Since the counter-pressure plunger both exerts a counter-pressure during punching and is used to push back the punched stack, the machinery cost of the apparatus according to the invention is likewise lower.

Further advantages of the invention are likewise apparent from the subclaims and from the description which follows. In the description, the invention is explained in detail with reference to an example shown diagrammatically in the drawings.

Figure 2:
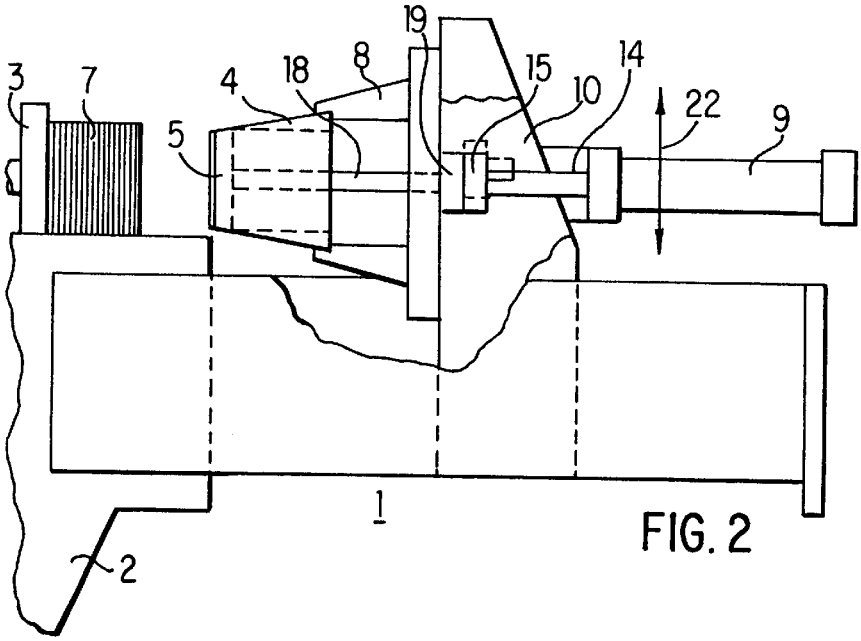
Figure 3:
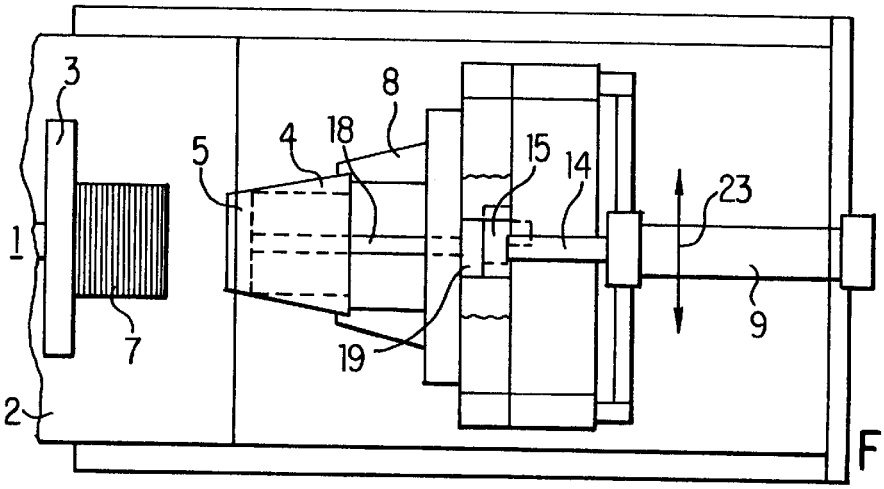
Figure 4A:
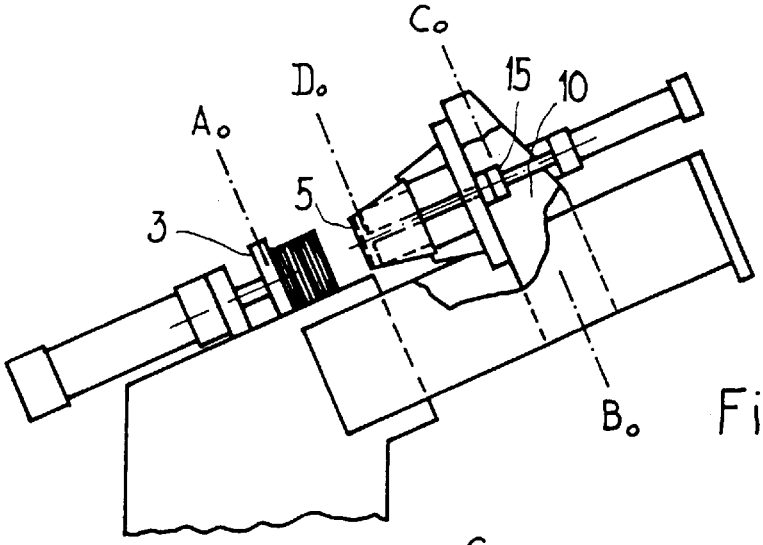
Figure 4B:
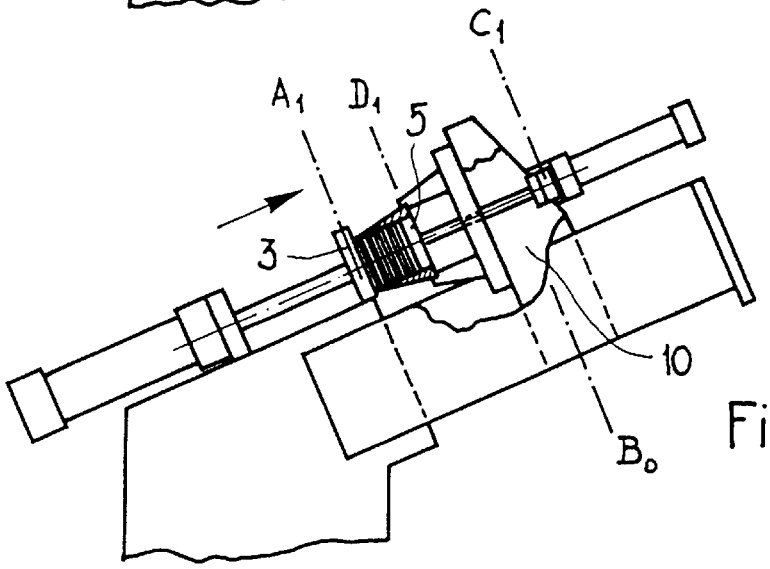
Figure 4C:
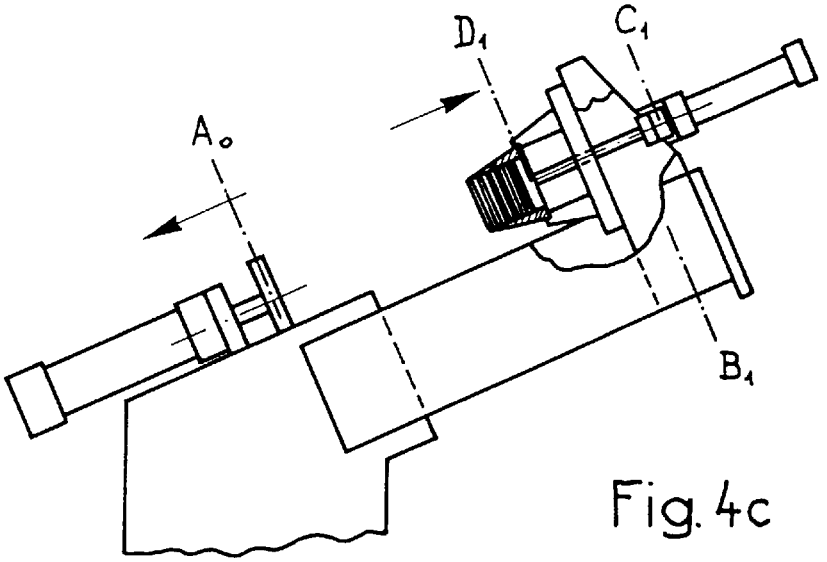
Figure 5A:
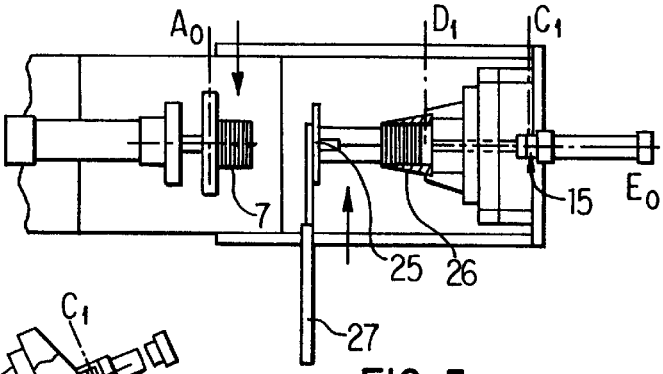
Figure 4D:
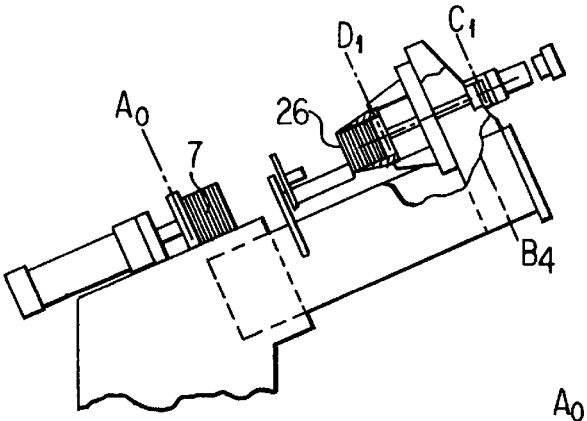
Figure 5B:
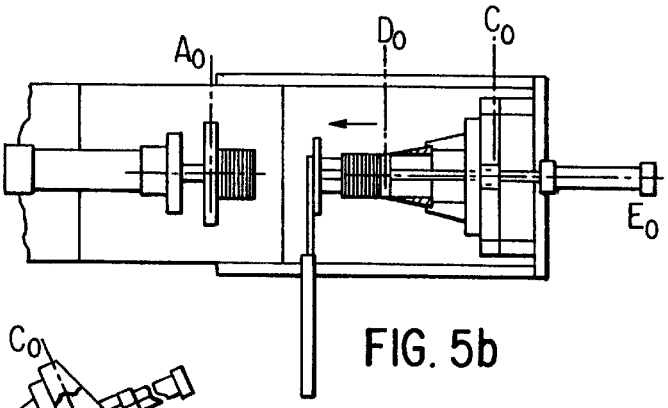
Figure 4E:
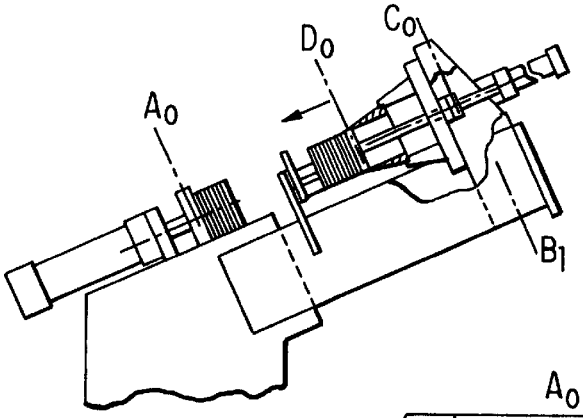
Figure 5C:
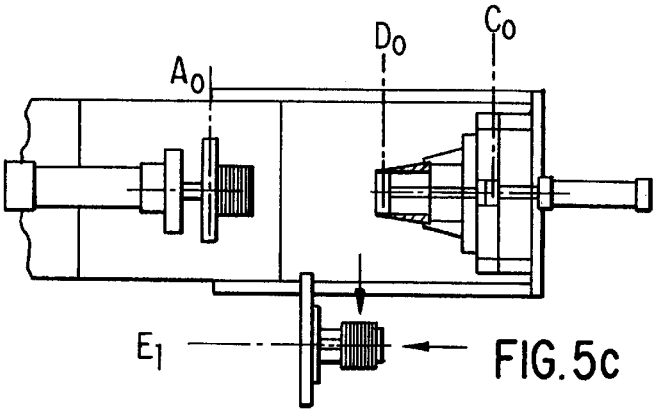

In the drawings:

FIG. 1 shows a lateral view of a label punching apparatus,

FIG. 2 shows an enlarged representation of the label punching apparatus according to FIG. 1, FIG. 3 shows a top view, in an enlarged representation, of the label punching apparatus according to FIG. 1, FIGS. 4*a*–4*e* snow stages of the punching method with the label punching apparatus in the lateral view, and FIGS. 5*a*–5*c* show stages of the punching method with the label punching apparatus in a top view.

In the figures, the same reference symbols are used for the same elements on each occasion, so that an initial statement relating to a particular element is valid for all figures.

In FIGS. 1, 2 and 3, a label punching apparatus 1 is shown entirely diagrammatically, having in essence a machine frame 2 with a punching ram 3, a punching knife 4 and a counter-pressure plunger 5. The punching ram 3 is reciprocally movable by means of a hydraulically actuated piston (not seen here) in a plunger cylinder 6. The punching material 7, a stack of sheet-like articles such as sheets of paper, thin paperboard or the like, lies against the punching ram 3. The punching knife 4 is fixed in a mounting 8 by means of which the punching outline of the punching knife 4 can be adjusted if necessary and other punching knives can be fitted. This mounting 8 is designed in the form of two screw-clamps, which set the punching outline in two dimensions at right angles to one another. The counter-pressure plunger 5 can be moved backwards and forwards in a counter-pressure cylinder 9 by means of the hydraulically actuated piston (not shown). The mounting 8 is fixed in a stationary manner on a carriage 10 in which the counter-pressure plunger 5 is mounted to be reciprocally movable. The counter-pressure cylinder 9 is likewise fixed in a stationary manner on the carriage 10. The carriage 10 itself is mounted on an extension arm 11 on the machine frame 2 to be reciprocally movable by means of a piston-and-cylinder unit which is not shown here. The carriage 10 can be fixed by means of a mechanical catch 10*a* for the actual punching operation. This catch may be embodied in a known manner by a non-positive lock or alternatively hydraulically. As can be seen in FIG. 1 the punching ram 3 can be moved in an inclined plane 12, which forms an angle of approximately 25° with the horizontal or level plane on which the machine frame 2 is mounted. The extension arm 11 is fixed on the machine frame 2 parallel to this plane 12, so that the carriage 10 is also mounted to be movable parallel to the inclined plane 12. The piston (not visible in FIG. 1) of the counter-pressure cylinder 9 is connected to a piston rod 14 and a cylindrical pressure ram 15. The counter-pressure plunger 5 has a guide rod 18 with a cylindrical head part 19. The longitudinal axis of the punching ram 3, the longitudinal axis of the counter-pressure plunger 5 and the longitudinal axis of the counter-pressure cylinder 9 are aligned in the inclined plane 12. The pressure ram 15 rests loosely by means of a plane surface on this cylindrical head part 19, in other words it is in non-positive connection with the latter, so that the mounting 8 for the punching knife 4 can be displaced independently of the counter-pressure cylinder 9 in order to be able to set the punching knife 4 to the desired label outline in displacement directions at right angles to the direction of movement. In FIGS. 2 and 3, this is indicated by the arrows 22 and 23 and the displacement of the pressure ram 15 is also indicated by broken lines. Since the counter-pressure plunger 5 is guided on the inner wall of the punching knife 4, a slight displacement of the cylindrical head part 19 out of the direction of movement has no effect on the pressure distribution in the stack 7.

The various working stages of the punching method are now described in detail with reference to FIGS. 4*a*–4*e* and 5*a*–5*c*. FIGS. 4*a*–5*c* show of the label punching apparatus 1, as shown in FIGS. 1 and 2, and FIGS. 5*a*–5*c* show a plan view, as shown in FIG. 3. In particular, the three last stages of the stamping method are explained with reference to FIGS. 5*a*–5*c*. The coordinates A, B, C and D indicated below are to be understood as abscissae relative to the inclined plane 12. The coordinate E lies on an axis at right angles to the inclined plane 12.

FIG. 4*a* shows the basic position of the label punching apparatus 1. In this figure, the punching ram 3 is located in an initial position $A_0$. in which the stack 7 of precut labels is arranged on the punching ram 3. The carriage 10 with the punching knife 4 is located in the punching position $B_0$, in which the carriage 10 is fixed by means of the abovementioned mechanical catch. The pressure ram 15 is located in an initial position $C_0$, which simultaneously defines the position Do of the counter-pressure ram 5, in which the counter-pressure ram 5 protrudes with a slight projection beyond the punching knife 4 (compare also FIGS. 2 and 3). The coordinates $C_0$ and $D_0$ are based on the coordinate $B_0$ of the carriage 10, in other words they are defined in the moving coordinate system of the carriage 10.

The next stage is shown in FIG. 2*b*, in which the stack 7 of precut labels is pushed by means of the punching ram 3 against the counter-pressure plunger 5 into the final position $A_1$. The counter-pressure plunger 5 presses with a predetermined and constant force against the punching material, as a result of which the stack 7 is stabilized and fixed, and at the same time the air still remaining between the sheets is pressed out. Thereafter the stack 7 is pushed through the punching knife 4, the pressure ram 15 being pushed into the end position $C_1$ and the counter-pressure plunger 5 into the end position $D_1$.

In the next situation shown in FIG. 4*c* the carriage 10 has been moved back into a retracted position $B_1$ and, at the same time, the punching ram 3 has been brought back into the initial position $A_0$. The pressure ram 15 and the counter-pressure plunger 5 remain in their end positions $C_1$ and $D_1$, based on the carriage 10, no counter-pressure now being exerted by the counter-pressure cylinder 9 on the counter-pressure plunger 5. Enough space is thus created between the punching knife 4, filled with punched labels, and the punching ram 3 for it to be possible to push in a receiving apparatus 25 for the stack 26 of ready-punched labels, as is shown in the stages according to FIGS. 4*d* and 5*a*. The receiving apparatus 25 is, in this stage, pushed on an auxiliary rest 27 (visible only in FIG. 5*a*) into the receiving position $E_0$. As soon as the punching ram 3 is again located in the initial position $A_0$, a new stack 7 of precut labels can at once be presented and aligned. This can be done automatically or manually. A great saving of time can be achieved thereby.

As shown in FIG. 4*e* and FIG. 5*b*, the stack 26 of punched labels located in the punching knife 4 is then pressed by the counter-pressure plunger 5 out of the punching knife 4 and pushed onto the receiving apparatus 25. The pressure ram 15 and the counter-pressure plunger 5 are then once again in their initial positions $C_0$ and $D_0$, the counter-pressure plunger 5 again protruding with a small projection relative to the front edge of the punching knife 4.

Subsequently, as shown in FIG. 4*f* and FIG. 5*c*, the receiving apparatus 25 with the stack 26 of finished labels is moved away laterally out of the punching area into the transfer position $E_1$, and the stack 26 can then be passed to a further processing stage, such as for example a banding unit.

After this stage the carriage 10 is again brought into the punching position $B_0$, as shown in FIG. 4*a*, and the newly presented stack 7 of sheet-like articles can be punched in a subsequent working cycle.

It is self-evident that the punching knife 4 with the counter-pressure plunger 5 need not necessarily be mounted movably on a carriage 10. In an alternative embodiment of the label punching apparatus 1 described above, in fact, the punching ram 3 could be movably mounted on a carriage and the punching knife 4 fixed in a stationary manner to the machine frame 2, and space for the removal of the stack 26 of already-punched labels could be created in this manner between the punching ram 3 and the punching knife 5. Nor is it absolutely necessary for the carriage 10 to move parallel to the inclined plane 12, but a direction of movement at right angles thereto could also create the necessary space. However, in such an alternative embodiment, the mechanical construction of the label punching apparatus again becomes more complex, which is avoided so far as possible by the embodiment shown in the figures, which is preferred.

I claim:

1. A method for punching a stack of flat articles, comprising:

arranging a punching ram and a hollow-cylindrical punching knife at a first distance with respect to one another;

placing the stack of flat articles for punching onto the punching ram while the punching ram is in a receiving position;

moving the punching ram into an end position towards the punching knife so that the stack of flat articles is moved into the punching knife to perform the punching operation;

holding the punching knife in a fixed punching position during the punching operation;

exerting a counter-pressure on the stack of flat articles prior to and during the punching operation;

retracting the punching ram from the end position to the receiving position after the stack of flat articles is punched;

moving the punching ram and the punching knife apart from one another after completing the punching operation, thereby creating an enlarged area between the punching ram and the punching knife, wherein the steps of (i) retracting the punching ram and (ii) moving the punching ram and the punching knife apart from one another after the punching operation, are performed simultaneously;

moving a receiving apparatus into the enlarged area;

pushing a stack of punched articles from the punching knife towards the enlarged area and onto the receiving apparatus;

moving the receiving apparatus and the stack from the enlarged area;

loading the punching ram with a new stack of flat articles for punching after the punching ram has reached its receiving position;

moving the punching knife into the punching position so that the punching ram and punching knife are at the first distance with respect to one another; and commencing a new cycle starting with moving the punching ram towards the punching knife.

2. The method of claim 1, wherein the punching knife is moved away from the punching ram from the punching position to a retracted position, thereby creating the enlarged area.

3. The method of claim 1, wherein the flat articles are labels.

4. The method of claim 3, further comprising fixing and stabilizing the labels when the counter-pressure is exerted on the labels.

5. The method of claim 3, further comprising pressing air from between the labels when the counter-pressure is exerted on the labels.

6. The method of claim 1, wherein a counter-pressure plunger exerts the counter-pressure on the stack of flat articles and the punching knife and the counter-pressure plunger are arranged on a carriage, and wherein the punching ram and the carriage are moved apart to form the enlarged area between the punching ram and the punching knife after the punching operation is completed.

7. The method of claim 6, wherein after the new stacks are loaded into the punching ram, the punching knife and the carriage are positioned in the punching position.

8. The method of claim 1, wherein the steps of (i) moving the receiving apparatus and the stack from the enlarged area and (ii) loading the punching ram with a new stack of articles are performed simultaneously.

9. An apparatus for punching a stack of flat articles, comprising:

a hollow-cylindrical punching knife;

a punching ram arranged opposite the punching knife;

means for moving the punching ram from a stack receiving position into an end position proximate to the punching knife and back to the receiving position;

a counter-pressure plunger movable in and guided within the punching knife, the counter-pressure plunger exerting a counter-pressure on the stack of flat articles moved by the punching ram, the counter-pressure plunger protruding past the punching knife in a forward end position and being movable backwards out of the forward end position;

a carriage movable from a punching position away from the punching ram into a rearward end position and back into the punching position, the punching knife and the counter-pressure plunger being arranged on the carriage, wherein an enlarged area is created between the punching ram and the punching knife when the carriage is in the rearward end position;

a receiving apparatus movable from a discharge position into a receiving position, the receiving apparatus being arranged in the enlarged area when in the receiving position; and actuating means for moving the counter-pressure plunger towards the forward end position when the receiving apparatus is in the receiving position, thereby discharging a stack of punched flat articles out of the punching knife onto the receiving apparatus.

10. The apparatus of claim 9, further comprising releasable mechanical locking means for fixing the carriage in the punching position during the punching operation.

11. The apparatus of claim 9, further comprising actuating means for exerting a pressure on the counter-pressure plunger.

12. The apparatus of claim 11, wherein the actuating means comprises a fluid-operated plunger acting on a head part attached to one end of a guide shaft, and wherein the counter-pressure plunger is attached to the other end of the guide shaft.

13. The apparatus of claim 12, wherein the plunger has a flat surface which contacts a flat surface of the head part.

14. The apparatus of claim 13, further comprising holding means for holding the punching knife, the holding means being releasably attached to the carriage.

15. The apparatus of claim 9, wherein the direction of movement of the punching ram and the carriage are parallel to one another.

16. The apparatus of claim 15, wherein the direction of movement of the punching ram and the carriage are arranged in an inclined plane relative to a horizontal plane.

17. The apparatus of claim 9, wherein the punching knife is fixed to a machine frame.

18. The apparatus of claim 17, wherein the flat articles are labels, and wherein the enlarged area is created between the fixed punching knife and movable punching ram.

* * * * *